US011925977B2

(12) United States Patent
Xie et al.

(10) Patent No.: US 11,925,977 B2
(45) Date of Patent: Mar. 12, 2024

(54) METHOD OF PREPARING ALUMINUM FOAM SANDWICH MATERIAL BY ROTATING FRICTION EXTRUSION AND ELECTROMAGNETIC PULSE HYBRID PROCESS

(71) Applicant: Nanchang Hangkong University, Nanchang (CN)

(72) Inventors: Jilin Xie, Nanchang (CN); Jinyang Hu, Nanchang (CN); Yuhua Chen, Nanchang (CN); Timing Zhang, Nanchang (CN); Limeng Yin, Nanchang (CN); Xiao Song, Nanchang (CN); Shanlin Wang, Nanchang (CN); Jiaming Ni, Nanchang (CN)

(73) Assignee: NANCHANG HANGKONG UNIVERSITY, Nanchang (CN)

( * ) Notice: Subject to any disclaimer, the term of this patent is extended or adjusted under 35 U.S.C. 154(b) by 65 days.

(21) Appl. No.: 18/136,343

(22) Filed: Apr. 19, 2023

(65) Prior Publication Data

US 2023/0339016 A1 Oct. 26, 2023

(30) Foreign Application Priority Data

Apr. 22, 2022 (CN) ..... 202210429188.6

(51) Int. Cl.
*B22D 25/00* (2006.01)
*B22F 3/11* (2006.01)

(52) U.S. Cl.
CPC ..... *B22D 25/005* (2013.01); *B22F 3/1125* (2013.01)

(58) Field of Classification Search
CPC .... B23K 20/227; B23K 20/122; B23K 20/06; B23K 20/1275; B23K 20/16; B23K 20/2333; B23K 20/023; B22D 25/005; B22F 3/1125; B22F 3/1121; B22F 3/1128; B22F 3/1131; B22F 7/006
See application file for complete search history.

(56) References Cited

FOREIGN PATENT DOCUMENTS

| | | | |
|---|---|---|---|
| CN | 102601509 A | | 7/2012 |
| CN | 104175623 A | * | 12/2014 |
| CN | 104175623 A | | 12/2014 |

(Continued)

*Primary Examiner* — Ricardo D Morales
(74) *Attorney, Agent, or Firm* — Bayramoglu Law Offices LLC

(57) ABSTRACT

A method for preparing aluminum foam sandwich material by rotating friction extrusion and electromagnetic pulse hybrid process includes: step 1: preparing the filler; step 2: processing the filler to prepare a plurality of preforms; step 3: clamping and fixing the plurality of preforms to form a preform assembly; step 4: welding the panel on the surface of the preform assembly to form an non-foaming sandwich material; step 5: heating and foaming the non-foaming sandwich material through a foaming mold; step 6: insulating the foaming mold after completion of foaming; injecting cooling water into the foaming mold after completion of insulation to maintain pressure and shape, forming the aluminum foam sandwich material of the required shape. The aluminum foam sandwich material produced by this method has good interface bonding, no adverse interface reaction, high bending resistance, impact resistance, and excellent sound absorption and insulation properties.

4 Claims, 5 Drawing Sheets

(56) References Cited

FOREIGN PATENT DOCUMENTS

| | | | |
|---|---|---|---|
| CN | 105478994 | A | 4/2016 |
| CN | 109048221 | A | 12/2018 |
| CN | 111215630 | A | 6/2020 |
| CN | 111805170 | A | 10/2020 |
| CN | 113275735 | A | 8/2021 |
| KR | 101282532 | B1 | 7/2013 |

* cited by examiner

METHOD OF PREPARING ALUMINUM FOAM SANDWICH MATERIAL BY ROTATING FRICTION EXTRUSION AND ELECTROMAGNETIC PULSE HYBRID PROCESS

CROSS REFERENCE TO THE RELATED APPLICATIONS

This application is based upon and claims priority to Chinese Patent Application No. 202210429188.6, filed on Apr. 22, 2022, the entire contents of which are incorporated herein by reference.

TECHNICAL FIELD

The present invention relates to the technical field of aluminum foam sandwich material preparation, in particular to a method of preparing aluminum foam sandwich material by rotating friction extrusion and electromagnetic pulse hybrid process.

BACKGROUND

Aluminum foam sandwich materials have the advantages of low density, high specific stiffness, good energy absorption, excellent damping characteristics, good thermal insulation and sound insulation, and are widely used in aviation, aerospace, ships, transportation and other fields, such as the fuselage, wings and tail wings of aircraft, the ship's plate, bus body, tram body. At present, the main preparation methods of aluminum foam sandwich materials are adhesive bonding, brazing and preform foaming. The aluminum foam sandwich material prepared by adhesive method cannot be used at high temperature (>200° C.); in the process of preparing aluminum foam sandwich materials by brazing, solder will be introduced, which will easily lead to adverse interface reactions between the aluminum foam sandwich layer and the panel and solder, and generate brittle intermetallic compounds; the preform foaming process is not only complex, but also the size of aluminum foam sandwich material is small.

At the same time, the patent with application number 201811194563.3 discloses a metal aluminum foam sandwich material, a processing method and a processing device. The cleaned panel material is placed on the aluminum foam plate, so that the panel material and the aluminum foam plate are completely overlapped, and clamped on the workbench with a clamp; conduct multi-pass full coverage on the surface of the panel material to present "snake or vortex" friction stir processing, so that the distance between two adjacent parallel processing axes is the diameter of the mixing needle of the processing device; turn over the processed panel material and aluminum foam plate as a whole, so that one side of the aluminum foam plate faces upward; place another panel material of the same specification on the overall overturned panel material and the aluminum foam plate, and conduct multiple full coverage stirring and friction processing in the form of "snake shaped or vortex shaped" again, to obtain the aluminum foam sandwich material structure. Although this technical scheme can effectively improve the strength of the joint between the core layer and the interlayer, it needs to insert the stirring pin into the aluminum foam core layer. The extrusion stirring effect on aluminum foam will significantly affect the porosity of the connection, and the production efficiency is low.

Therefore, it is urgent to design a method to prepare aluminum foam sandwich materials by rotating friction extrusion and electromagnetic pulse hybrid process to solve the above problems.

SUMMARY

The present invention aims to provide a method for preparing aluminum foam sandwich material by rotating friction extrusion and electromagnetic pulse hybrid process, including:

step 1: preparing the filler;

step 2: processing the filler to prepare a plurality of preforms;

step 3: clamping and fixing the plurality of preforms to form a preform assembly;

step 4: welding the panel on the surface of the preform assembly to form an non-foaming sandwich material;

step 5: heating and foaming the non-foaming sandwich material through a foaming mold;

step 6: insulating the foaming mold after completion of foaming; injecting cooling water into the foaming mold after completion of insulation to maintain pressure and shape, forming the aluminum foam sandwich material of the required shape.

Preferably, the preparation method of the filler is to provide a matrix, open a plurality of holes on the matrix, and fill the plurality of holes with foaming agent.

Preferably, the matrix is made of pure aluminum or aluminum alloy.

Preferably, the foaming agent in step 1 is titanium hydride.

Preferably, the preparation method of the preform is to place the filler in a rotary friction extrusion die and extrude it to form a plurality of preforms.

Preferably, the rotary friction extrusion die includes a mixing head, an upper die body, a lower die body and an extrusion rod. The upper die body is detachably connected to the specific top of the lower die body, and a mold cavity is formed between the upper die body and the lower die body, and the lower die body is penetrated with an extrusion port; the mixing head is rotationally connected to the specific top of the upper die body, and the bottom end of the mixing head penetrates the specific upper die body and extends into the mold cavity; the extrusion rod is provided with two, and two feeding channels are also formed between the upper mold and the lower mold. The two feeding channels are connected with the mold cavity, and the two extrusion rods are respectively slided into the two feeding channels.

Preferably, the processing method of the preform is to put the filler into the feeding channel, move the extrusion rod to the mold cavity, send the filler to the mold cavity, rotate the mixing head to break and stir the filler, and finally extrude along the extrusion port.

Preferably, the panel and the preform assembly are welded by electromagnetic pulse welding.

Preferably, the preform assembly is formed by clamping and fixing the plurality of preforms according to the sectional shape of the aluminum foam sandwich material to be molded.

The present invention discloses the following technical effects:

1. The present invention uses the stirring friction extrusion die to prepare the preform, which solves the shortage of the traditional powder mixing extrusion process to prepare the length limitation after single extrusion. The method of preparing the preform in the application can ensure the continuity of the extrusion material under the condition of intermittent feeding.

2. In the present invention, the panel is then welded with the preform assembly by electromagnetic pulse welding. According to the electromagnetic induction law and skin effect, the coil and the panel generate mutually exclusive magnetic force that changes with time. Under the effect of this magnetic force, the panel impacts the preform assembly at a high speed to form metallurgical bonding, which solves the problem of introducing solder in the process of preparing aluminum foam sandwich materials by brazing. It is easy to cause adverse interface reaction between aluminum foam sandwich layer and panel and filler metal, and generate brittle intermetallic compounds.

3. The present invention adopts integrated forming to produce aluminum foam sandwich material, and can produce large size aluminum foam sandwich material.

4. The aluminum foam sandwich material produced by the present invention has the advantages of being able to serve at high temperature (>200° C.), good interface bonding, no adverse interface reaction, high bending resistance, impact resistance, and excellent sound absorption and insulation properties.

BRIEF DESCRIPTION OF THE DRAWINGS

In order to more clearly explain the embodiments of the present invention or the technical solutions in the prior art, the following will briefly introduce the drawings needed in the embodiments. It is obvious that the drawings in the following description are only some embodiments of the present invention. For ordinary technicians in the art, other drawings can also be obtained from these drawings without paying creative labor.

Figure 1:
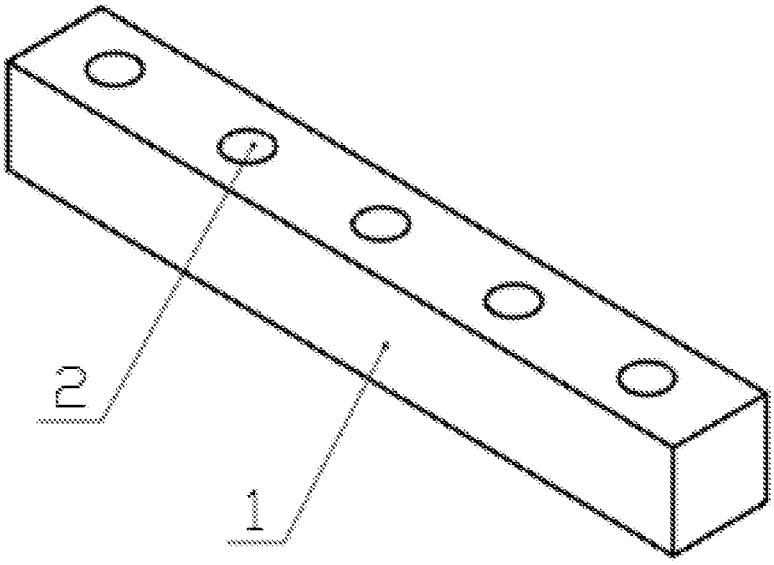
FIG. 1 is a structural diagram of the matrix with holes in the present invention.
Figure 2:
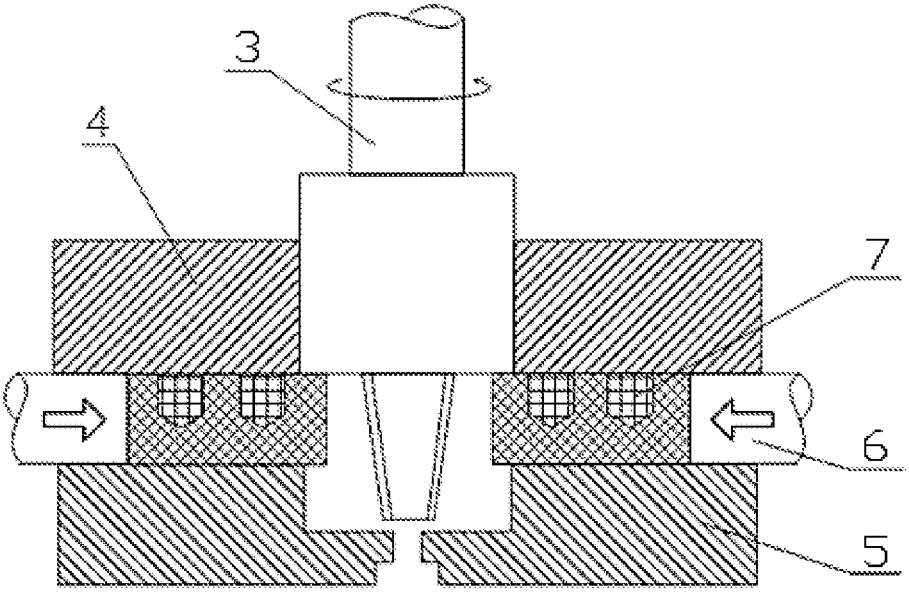
FIG. 2 is a schematic diagram of the rotary friction extrusion process.
Figure 3:
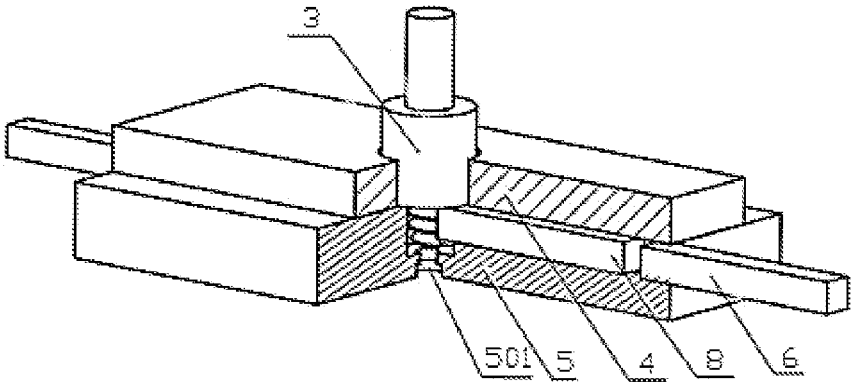
FIG. 3 is a three-dimensional axonometric diagram of the rotating friction extrusion process.
Figure 4:
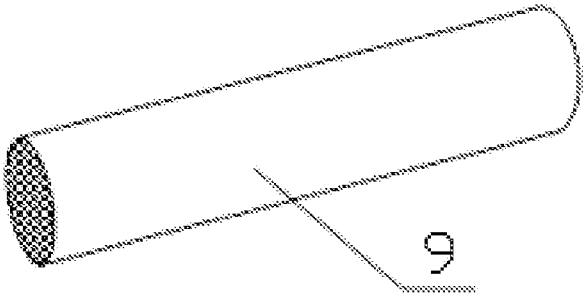
FIG. 4 is a structural diagram of the preform in the present invention.

Among them, 1. matrix; 2. hole; 3. mixing head; 4. upper die body; 5. lower die body; 501. extrusion port; 6. extrusion rod; 7. foaming agent; 8. filler; 9. preform; 10. panel; 11. clamp; 12. welded joint; 13. coil; 1301. outer tube coil; 1302. inner tube coil; 14. aluminum foam; 15. foaming mold; 1501. outer wall heating mold; 1502. inner wall heating mold; 16. cooling channel.

DETAILED DESCRIPTION OF THE EMBODIMENTS

The following will give a clear and complete description of the technical solution in the embodiments of the present invention in combination with the drawings in the embodiments of the present invention. Obviously, the described embodiments are only part of the embodiments of the present invention, not all of them. Based on the embodiments in the present invention, all other embodiments obtained by ordinary technicians in the art without creative work fall within the scope of protection of the present invention.

In order to make the above purposes, features and advantages of the present invention more obvious and understandable, the present invention will be further described in detail with the attached drawings and specific embodiments.

Referring to FIGS. 1-4, the present invention provides a method for preparing aluminum foam sandwich material by rotating friction extrusion and electromagnetic pulse hybrid process, including:

step 1: preparing the filler 8;

step 2: processing the filler 8 to prepare a plurality of preforms 9;

step 3: clamping and fixing the plurality of preforms 9 to form preform assembly;

step 4: welding the panel 10 on the surface of the preform assembly to form the non-foaming sandwich material;

step 5: heating and foaming the non-foaming sandwich material through the foaming mold 15;

step 6: insulating the foaming mold 15 after completion of foaming; injecting cooling water into the foaming mold 15 after completion of insulation to maintain pressure and shape, forming the aluminum foam sandwich material of the required shape.

Further, the panel 10 is made of metal.

Further, the foaming mold 15 is provided with a cooling channel 16.

Further, the preparation method of filler 8 is to provide a matrix 1, open a plurality of holes 2 on the matrix 1, and fill a plurality of holes 2 with foaming agent 7.

Further, the matrix 1 is made of pure aluminum or aluminum alloy.

Further, the foaming agent 7 in step 1 is titanium hydride.

Further, the preparation method of preform 9 is to place the filler 8 in the rotary friction extrusion die and extrude to form a plurality of preforms 9.

Further, the rotary friction extrusion die includes the mixing head 3, the upper die body 4, the lower die body 5 and the extrusion rod 6. The upper die body 4 can be detachably connected to the top of the lower die body 5, the mold cavity is formed between the upper die body 4 and the lower die body 5, and the lower die body 5 is provided with an extrusion port 501 through; the mixing head 3 is rotationally connected to the top of the upper die body 4, and the bottom end of the mixing head 3 penetrates the upper die body 4 and extends into the mold cavity; the extrusion rod 6 is equipped with two, and two feeding channels are also formed between the upper die body 4 and the lower die body 5. Both feeding channels are connected with the mold cavity, and the two extrusion rods 6 are respectively connected in two feeding channels.

Further, the processing method of preform 9 is to put the filler 8 into the feeding channel, move the extrusion rod 6 to the mold cavity, send the filler 8 to the mold cavity, rotate the mixing head 3 to break and stir the filler 8, and finally extrude along the extrusion port 501.

The preparation of preform 9 using a stirring friction extrusion die solves the shortage of the traditional powder mixing extrusion process to prepare the limited length after a single extrusion. The method of preparing preform 9 in this application can ensure the continuity of the extrusion material under the condition of intermittent feeding.

Further, the panel 10 and the preform assembly are welded by electromagnetic pulse welding.

The electromagnetic pulse welding is used to weld the panel 10 and the preform assembly, which solves the problem that solder will be introduced in the process of preparing aluminum foam sandwich materials by brazing, which will easily lead to adverse interface reactions between the aluminum foam 14 sandwich layer and the panel 10 and solder, and generate brittle intermetallic compounds.

Further, the prefabricated components are fixed by a plurality of preforms 9 according to the section shape of the aluminum foam sandwich material to be molded, avoiding the later welding link, and ensuring the overall performance of the molded aluminum foam sandwich material.

Embodiment 1

Figure 5:
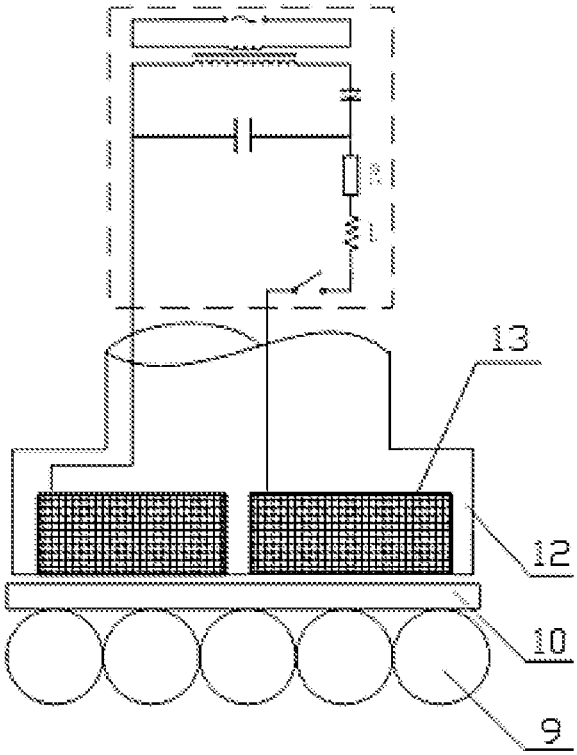
FIG. 5 is a schematic diagram of a welded panel on one side of a preform assembly in Embodiment 1 of the present invention.
Figure 6:
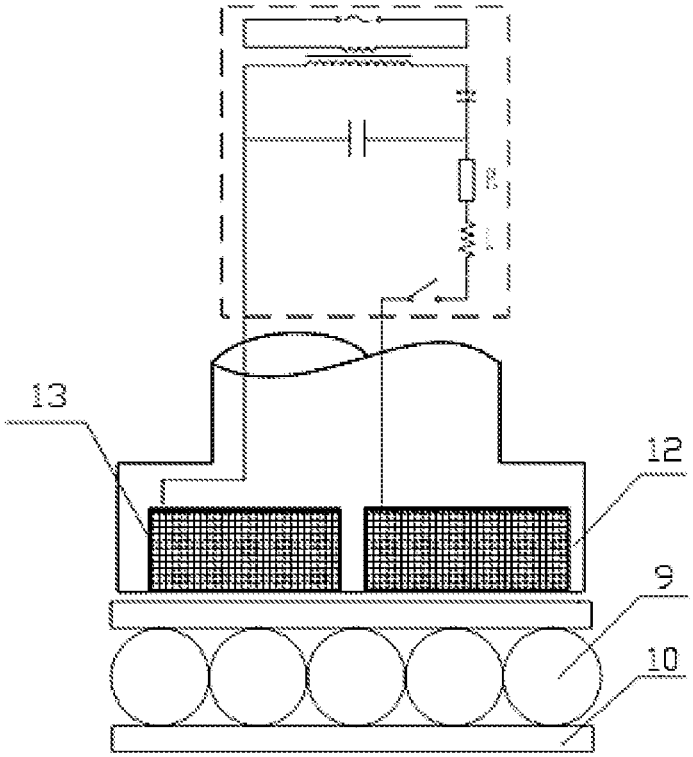
FIG. 6 is a schematic diagram of the welding panel on the other side of the preform assembly in Embodiment 1 of the present invention.
Figure 7:
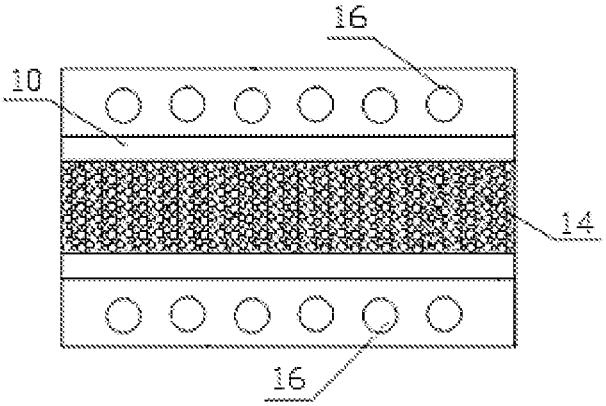
FIG. 7 is a schematic diagram of flat foaming forming in Embodiment 1 of the present invention.

Referring to FIGS. 5-7, when the aluminum foam sandwich material is flat, a plurality of holes 2 are opened on the matrix 1 of pure aluminum or aluminum alloy. In order to ensure that the mixture can be more evenly mixed with the foaming agent 7 during subsequent crushing and mixing, a plurality of holes 2 are equally spaced along the length direction of the matrix 1. The foaming agent 7 uses titanium hydride, and puts the filler 8 into the feeding channel. The extrusion rod 6 moves to the mold cavity to send the filler 8 to the mold cavity. The mixing head 3 rotates to break and stir the filler 8, and finally makes the matrix 1 and foaming agent 7 uniformly mixed to form a mixture. With the continuous increase of the mixture in the mold cavity, the pressure increases, and finally extrudes along the extrusion port 501 on the lower die body 5 to form a columnar preform 9. A plurality of preforms 9 are clamped and fixed by the clamp 11 to form planar preform assembly. Then the panel 10 is welded on both sides of the preform assembly by means of electromagnetic pulse welding. The welding device used in the electromagnetic pulse welding includes the welded joint 12 and the RLC oscillation circuit. The RLC oscillation circuit consists of a capacitor, a coil 13 and a discharge circuit. The coil 13 is fixed and embedded at the bottom of the welded joint 12. Before welding, the energy is stored in the capacitor. When the discharge switch in the discharge circuit is closed instantaneously, There is a large transient alternating current flowing through the coil 13, which generates a strong alternating magnetic field. According to the law of electromagnetic induction and skin effect, this magnetic field will generate an induced current on the surface of the panel 10 that is opposite to the current of the coil 13. The induced current will also generate an induced magnetic field, which prevents the magnetic field of the coil 13 from penetrating the panel 10. There is a mutually exclusive magnetic force between the coil 13 and the panel 10 that changes with time, Under the action of this magnetic force, the panel 10 impacts the preform components at high speed to form metallurgical bonding to form an non-foaming sandwich material, then heats and insulates the non-foaming sandwich material through a foaming mold 15 matched with the non-foaming sandwich material, and finally passes cold water into the foaming mold 15 to form a flat aluminum foam sandwich material by pressure holding and shaping. The aluminum foam sandwich material produced by this method has the advantages of being able to produce large size aluminum foam sandwich materials, serving at high temperature (>200° C.), good interface bonding, no adverse interface reaction, high bending resistance, impact resistance, and excellent sound absorption and insulation properties.

Embodiment 2

Figure 8:
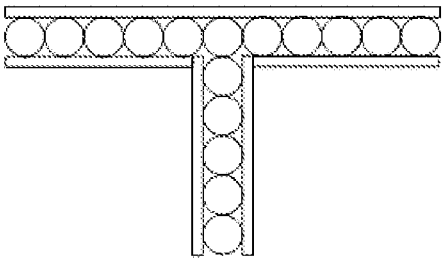
FIG. 8 is a schematic diagram of T-shaped non-foaming sandwich material in Embodiment 2 of the present invention.
Figure 9:
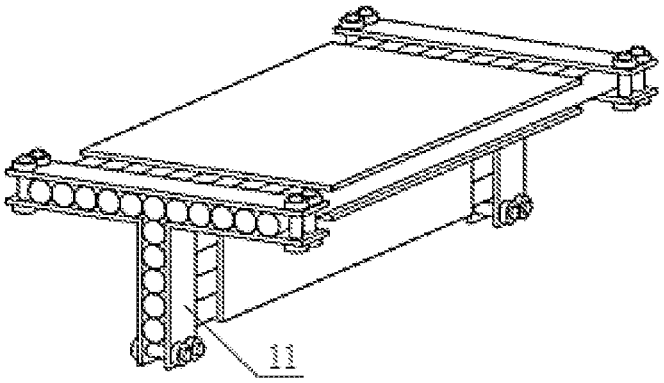
FIG. 9 is a schematic diagram of welding and clamping of T-shaped non-foaming sandwich material in Embodiment 1 of the present invention.
Figure 10:
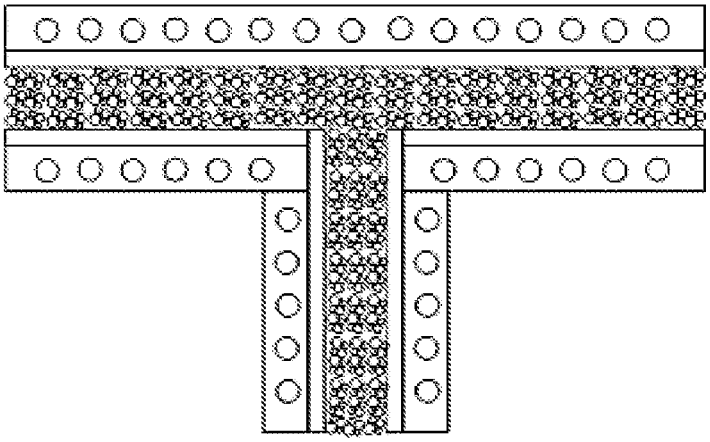
FIG. 10 is a diagram of T-shaped foam forming in Embodiment 1 of the present invention.

Referring to FIGS. 8-10, when the aluminum foam sandwich material is T-shaped, the preform 9 is made by the same method as in Embodiment 1, a plurality of preforms 9 are clamped and fixed to form a T-shaped preform assembly by the clamp 11, and then the panel 10 is welded on both sides of the vertical surface of the preform assembly by electromagnetic pulse welding, and then the panel 10 is welded on both sides of the horizontal surface. The welding device used for electromagnetic pulse welding is the same as in Embodiment 1. Non-foaming sandwich materials are formed after welding, and then the non-foaming sandwich materials are heated and insulated through the foaming mold 15 matching with the non-foaming sandwich materials, and finally cooling water is injected into the foaming mold 15 to form a flat aluminum foam sandwich material by pressure holding and shaping. The aluminum foam sandwich material produced by this method has the same advantages as Embodiment 1. At the same time, because the traditional preparation process is to prepare two foam sandwich plates first, and then weld or connect them, but the core of the foam sandwich material is foam structure, and cannot be prepared under force. However, this application constructs a T-shaped structure first, then foams, and forms integrally in the stage of forming prefabricated components. It has solved the problems existing in the traditional process.

Embodiment 3

Figure 11:
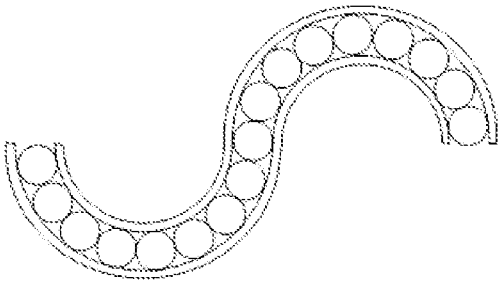
FIG. 11 is a schematic diagram of the curved non-foaming sandwich material in Embodiment 3 of the present invention.

Referring to FIG. 11, when the aluminum foam sandwich material is curved, the preform 9 is made by the same method as in Embodiment 1, a plurality of preforms 9 are clamped and fixed to form curved preform components by the clamp 11, and then the panels 10 are welded on both sides of the preform components by electromagnetic pulse welding. The welding device used for electromagnetic pulse welding is the same as in Embodiment 1, and the non-foaming sandwich material is formed after welding. Then, the non foaming sandwich material is heated and insulated through the foaming mold 15 matched with the non foaming sandwich material, and finally cooling water is introduced into the foaming mold 15 to form a flat aluminum foam sandwich material by pressure holding and shaping. The aluminum foam sandwich material produced by this method has the same advantages as Embodiment 1, and it also solves the problem that when the curved surface foam sandwich material is traditionally prepared, the preform 9 plates are first prepared by stirring and friction processing, and then forged and foamed by molds, which is not suitable for large-scale production under low production efficiency.

Embodiment 4

Figure 12:
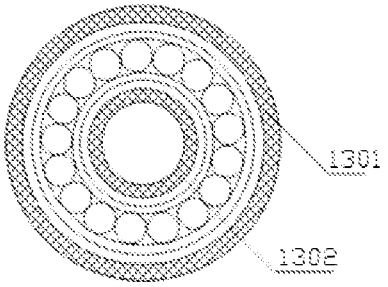
FIG. 12 is a schematic diagram of tubular non-foaming sandwich material in Embodiment 4 of the present invention.
Figure 13:
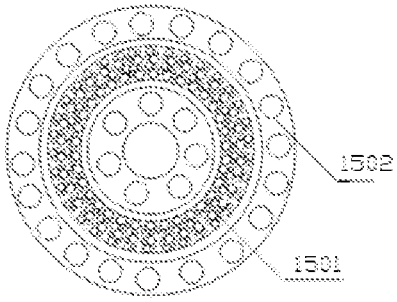
FIG. 13 is a schematic diagram of tubular foaming forming in Embodiment 4 of the present invention.

Referring to FIGS. 12-13, when the aluminum foam sandwich material is tubular, the preform 9 is made by the same method as in Embodiment 1, a plurality of preforms 9 are clamped and fixed to form tubular preform components by the clamp 11, and then the panel 10 is welded on the inside and outside of the preform components by electromagnetic pulse welding. The welding device used for electromagnetic pulse welding includes coil 13 and RLC oscillation circuit. The coil 13 includes the inner tube coil 1302 and the outer tube coil 1301. After welding, the non-foamed sandwich material is formed, and then the non-foamed sandwich material is heated and insulated through the foaming mold 15 that is compatible with the non-foamed sandwich material. The foaming mold 15 includes the inner wall heating mold 1502 and the outer wall heating mold 1501. The inner wall heating mold 1502 and the outer wall heating mold 1501 are both provided with cooling channels 16, Finally, cooling water is introduced into the cooling channel 16 to form a flat aluminum foam sandwich material. The aluminum foam sandwich material made by this method has the same advantages as Embodiment 1, and also solves the problem that it is difficult to make a longer specification by the traditional preparation process.

In the description of the present invention, it is necessary to understand that the orientation or position relationship indicated by the terms "longitudinal", "horizontal", "up", "down", "front", "back", "left", "right", "vertical", "horizontal", "top", "bottom", "inside", "outside", etc. is based on the orientation or position relationship shown in the attached drawings, only for the convenience of describing the present invention. Rather than indicating or implying that the device or element referred to must have a specific orientation, be constructed and operated in a specific orientation, it cannot be understood as a limitation of the present invention.

The embodiment mentioned above is only to describe the preferred method of the present invention, not to limit the scope of the present invention. On the premise of not deviating from the design spirit of the present invention, all kinds of deformation and improvement of the technical scheme of the present invention made by ordinary technical personnel in the field shall fall into the scope of protection determined by the claim of the present invention.

What is claimed is:

1. A method for preparing an aluminum foam sandwich material by rotating friction extrusion and electromagnetic pulse hybrid process, comprising:

step 1: preparing a filler, wherein a preparation method of the filler is to provide a matrix, open a plurality of holes on the matrix, and fill the plurality of holes with a foaming agent;

step 2: processing the filler to prepare a plurality of preforms, wherein a preparation method of the plurality of preforms is to place the filler in a rotary friction extrusion die and extrude to form the plurality of preforms;

wherein the rotary friction extrusion die comprises a mixing head, an upper die body, a lower die body and an extrusion rod;

the upper die body is detachably connected to a top of the lower die body, a mold cavity is formed between the upper die body and the lower die body, and the lower die body is provided with an extrusion port through;

the mixing head is rotationally connected to a top of the upper die body, and a bottom end of the mixing head penetrates the upper die body and extends into the mold cavity;

the extrusion rod is equipped with two, and two feeding channels are further formed between the upper die body and the lower die body;

the two feeding channels are communicated with the mold cavity, and the two extrusion rods are respectively slidingly connected in the two feeding channels;

step 3: clamping and fixing the plurality of preforms to form a preform assembly, wherein the preform assemblies are clamped and fixed by the plurality of preforms according to a section shape of the aluminum foam sandwich material to be molded;

step 4: welding a panel on a surface of the preform assembly to form a non-foaming sandwich material, wherein the panel and the preform assembly are welded by electromagnetic pulse welding;

step 5: heating and foaming the non-foaming sandwich material through a foaming mold;

step 6: insulating the foaming mold after a completion of foaming; injecting a cooling water into the foaming mold after a completion of insulation to maintain a pressure and a shape, forming the aluminum foam sandwich material of a required shape.

2. The method for preparing the aluminum foam sandwich material by rotating friction extrusion and electromagnetic pulse hybrid process according to claim 1, wherein the matrix is made of pure aluminum or aluminum alloy.

3. The method for preparing the aluminum foam sandwich material by rotating friction extrusion and electromagnetic pulse hybrid process according to claim 1, wherein the foaming agent in step 1 is titanium hydride.

4. The method for preparing the aluminum foam sandwich material by rotating friction extrusion and electromagnetic pulse hybrid process according to claim 1, wherein a processing method of the preform is to put the filler into the feeding channel, move the extrusion rod to the mold cavity, send the filler to the mold cavity, rotate the mixing head to break and stir the filler, and finally extrude along the extrusion port.

* * * * *